US006060970A

United States Patent [19]

Bell

[11] Patent Number: 6,060,970

[45] Date of Patent: May 9, 2000

[54] FOCUSED MAGNETIZATION DEVICE

[76] Inventor: James F. Bell, 308 Hazel St., Warren, Pa. 16365

[21] Appl. No.: 09/215,584

[22] Filed: Dec. 17, 1998

Related U.S. Application Data

[60] Provisional application No. 60/068,508, Dec. 22, 1997.

[51] Int. Cl.[7] ..... H01F 7/20

[52] U.S. Cl. ..... 335/285; 335/284; 335/302

[58] Field of Search ..... 335/284, 285, 335/289, 302; 399/277

[56] References Cited

U.S. PATENT DOCUMENTS

| | | | |
|---|---|---|---|
| 3,219,889 | 11/1965 | Polushkin | 335/284 |
| 3,417,295 | 12/1968 | Littwin | 335/284 |
| 4,359,765 | 11/1982 | Mimura et al. | 361/147 |
| 4,749,978 | 6/1988 | Imamura et al. | 335/284 |
| 5,659,280 | 8/1997 | Lee et al. | 335/284 |

*Primary Examiner*—Lincoln Donovan
*Assistant Examiner*—Tuyen T. Nguyen
*Attorney, Agent, or Firm*—Tipton L. Randall

[57] ABSTRACT

The invention is a fixture assembly for magnetizing a permanent magnet hollow cylindrical member to produce a high axial magnetic field in the cylindrical member's axial bore. The fixture assembly has at least one high permeability soft magnetic component positioned along the cylindrical member's longitudinal axis. A means for maintaining the high permeability soft magnetic component positioned along the cylindrical member's longitudinal axis is present. A means for directing a high magnetic field through the high permeability soft magnetic component and hollow cylindrical member provides magnetization of the cylindrical member.

Also disclosed is a method of magnetizing a hollow cylindrical member to produce a high axial magnetic field in the cylindrical member's axial bore using the fixture assembly.

13 Claims, 6 Drawing Sheets

GEOMETRY OF
MAGNET HOLDER

IDEALIZED EIGHT POLE RADIAL MAGNETIZATION

STEEL CORED MULTIPOLE FIXTURE

"AIR CORED" WOUND CONDUCTOR FIXTURE

SCHEMATIC OF ACTUAL EIGHT POLE MAGNETIZATION PATTERN

SCHEMATIC OF FOCUSED FIELD IN THE BORE OF A SOLENOID FIXTURE

GEOMETRY OF MAGNET HOLDER

HOLLOW CYLINDRICAL MAGNET C WITH LONGITUDINAL AXIS A AND AXIAL BORE B

FOCUSED MAGNETIZATION DEVICE

CROSS REFERENCE TO RELATED APPLICATION

This application claims the benefit under 35 U.S.C. §119 (e) of co-pending provisional application Ser. No. 60/068,508, filed Dec. 22, 1997. Application Ser. No. 60/068,508 is hereby incorporated by reference.

FIELD OF THE INVENTION

The present invention relates to a method of producing improved magnetic performance in a permanent magnet, as well as a device for achieving this objective.

BACKGROUND OF THE INVENTION

Magnetization of permanent magnets is often the final step in the manufacturing process, and produces the required arrangement or pattern of poles in the product. This pattern can be as simple as a single pair of poles at either end of a bar or rod shaped magnet, or the pattern can be relatively complex, such as skewed, multi-pole patterns on the external surface of a hollow cylinder. The latter type of magnetization pattern is sometimes used in electric motor applications.

There are several ways of "imprinting" the required arrangement of poles, depending upon the complexity of the magnet, and the materials from which the magnet is made. The simplest method is to utilize the field from another permanent magnet, but this can only be used where the part can be magnetized in a low applied field. The next level is to use an electromagnet, either as a solenoid coil, or as part of a C-core magnetic circuit. For materials that are difficult to magnetize (high coercivity), the solenoid may need to be powered by a very high current discharge from a bank of capacitors.

These methods result in very simple magnetization patterns, typically with a north and a south pole at each end or face of the magnet, with the direction of magnetization being described by a single vector. For more complex patterns, such as the idealized eight pole configuration shown in FIG. 1, two other types of magnetization fixtures could be considered. The two include the steel cored fixture shown in FIG. 2, and the serpentine wound fixture shown in FIG. 3*a*. FIG. 3*b* is a cross sectional view of a hollow cylindrical magnet surrounded by the serpentine wound fixture of FIG. 3*a*. Because the field pattern that these two fixtures create is not uniform, as is the case in an ideal solenoid, the resulting magnetization of the part is complex and will tend to be represented by the pattern shown in FIG. 4. The resulting poles can no longer be described by a single vector, as in the ideal case, and the resulting field pattern above the surface of the magnet will also be different. Because of the focusing effect of the non-ideal pattern, the peak strength of the field above the center of each pole will be higher than in the ideal case, and the zero crossing slope will be shallower. Depending upon the application requirements, this result may or may not be of benefit.

This type of multi-pole focused magnetization pattern has been widely reported and used to benefit in many cases. However, the invention described herein utilizes some of the features of focused magnetization and applies them in a novel way, to enhance the performance of certain magnet geometries that are typically used in sensor applications.

Lee et al., in U.S. Pat. No. 5,659,280, disclose a system for forming desired magnetization patterns in permanent magnet structures such as magnetic brush cylinder cores, utilizing a fixture having a plurality of magnetizing members selectively orientable to the permanent magnet structures and couplable to a capacitor discharge magnetization apparatus. Magnetic tip members having different flux focusing end configurations are employed to form corresponding polarization patterns in the permanent magnet cylinder structures.

SUMMARY OF THE INVENTION

The invention is a fixture assembly for magnetizing a permanent magnet hollow cylindrical member to produce a high axial magnetic field in the cylindrical member's axial bore. The fixture assembly has at least one high permeability soft magnetic component positioned along the cylindrical member's longitudinal axis. A means for maintaining the high permeability soft magnetic component positioned along the cylindrical member's longitudinal axis is present. A means for directing a high magnetic field through the high permeability soft magnetic component and hollow cylindrical member provides magnetization of the cylindrical member.

Also disclosed is a method of magnetizing a hollow cylindrical member to produce a high axial magnetic field in the cylindrical member's axial bore using the fixture assembly.

BRIEF DESCRIPTION OF THE DRAWINGS

Reference is next made to a brief description of the drawings, which are intended to illustrate the preferred embodiment of the present invention with respect to the manner of making and using the same in its presently understood best mode. The drawings and the detailed description which follow are intended to be merely illustrative and not otherwise limiting of the scope of the invention as set forth in the appended claims.

DESCRIPTION OF THE PREFERRED EMBODIMENT

Nomenclature:

C Hollow Cylindrical Member

B Axial Bore of Cylindrical Member

A Longitudinal Axis of Cylindrical Member

10 Fixture Assembly

20 Steel Ball Member

30 Holder Member

35 Bottom Portion of Holder Member

40 Top Portion of Holder Member

45 Closed End Aperture in Holder Member

50 Air Cored Solenoid Wound Conductor

60 Power Source

65 Terminal of Power Source

70 Terminal of Power Source

75 Charging Circuit Device

80 Capacitor Storage Means

85 Switching Device

Figure 6:
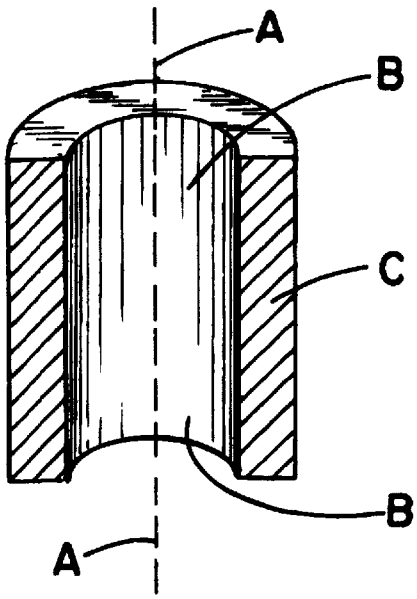
FIG. 6 is a cross sectional view of a hollow cylindrical magnet showing the longitudinal axis and axial bore thereof.

Construction:

The invention is a device for magnetizing a hollow cylindrical member C. Referring to FIG. 6, The hollow cylindrical member C to be magnetized is shown in cross sectional view. The hollow cylindrical member C has an axial bore B there through and a longitudinal cylindrical axis A. The hollow cylindrical member C is fabricated from isotropic material, such as bonded isotropic NdFeB composite or isotropic ferrite, suitable for accepting permanent magnetization.

The device of the present invention is a fixture assembly for magnetizing a permanent magnet hollow cylindrical member to produce a high axial magnetic field in the cylindrical member's axial bore. The fixture assembly has at least one high permeability soft magnetic component positioned along the cylindrical member's longitudinal axis. A means for maintaining the high permeability soft magnetic component positioned along the cylindrical member's longitudinal axis is present. A means for directing a high magnetic field through the high permeability soft magnetic component and hollow cylindrical member provides magnetization of the cylindrical member.

Figure 7:
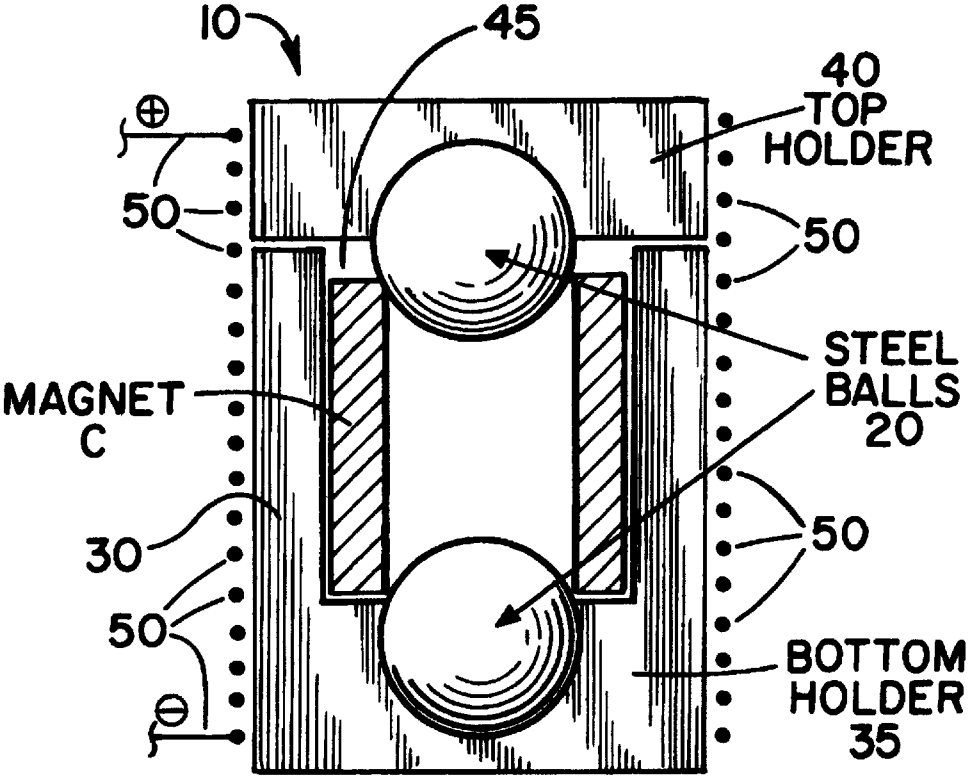
FIG. 7 is a cross sectional view of a magnet holder fixture containing a hollow cylindrical magnet with high permeability soft steel components positioned therein.

In FIG. 7, the fixture assembly 10 for imparting magnetization upon the hollow cylindrical member C is shown in cross sectional view. The fixture assembly 10 is composed of at least one high permeability soft magnetic component positioned along the cylindrical member's longitudinal axis A. The high permeability soft magnetic component of FIG. 7 is a pair of soft iron spherical members 20 positioned on the longitudinal axis of the hollow cylindrical member C. The soft iron spherical members 20 may be located such that these members 20 are completely exterior the hollow cylindrical member's axial bore B. Alternatively, the spherical members 20 are positioned at least partially within the hollow cylindrical member's axial bore B as shown in FIG. 7, or the spherical members 20 may be positioned completely within the hollow cylindrical member's axial bore B. When positioned completely within the hollow cylindrical member's axial bore B, the diameter of the spherical members 20 must be less than the diameter of the axial bore B. Where the diameter of the spherical members 20 exceed the diameter of the axial bore B, the spherical members 20 are conveniently positioned on the longitudinal axis A by contact with the ends of the hollow cylindrical member C.

The spherical members 20 are maintained on the cylindrical member's longitudinal axis A by means of a holder member 30. The holder member 30 is composed of a bottom portion 35 and a top portion 40. The bottom portion 35 contains a closed end aperture 45 with a diameter sufficient to accommodate the hollow cylindrical member C with the spherical members 20 positioned at each end thereof. The holder member top portion 40 covers the open end of the aperture 45, thereby securing the hollow cylindrical member C with adjacent spherical members 20 in a fixed configuration.

The holder member 30 is preferably fabricated from essentially non-magnetic materials with low electrical conductivity, such as wood or plastic.

There is provided a means for directing a high magnetic field through the high permeability soft magnetic component and hollow cylindrical member C to provide magnetization of the cylindrical member. A helical solenoid coil 50 is positioned exterior the holder member 30 and it is connected to a suitable power source 60 for directing the high current pulse through the solenoid coil. Alternatively, the solenoid coil 50 may be integrally contained within the holder member 30.

Figure 1:
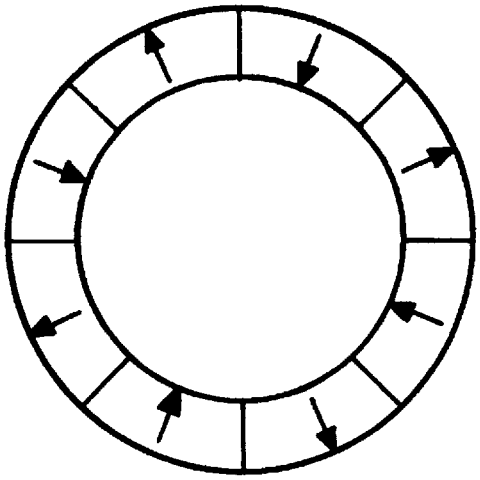
FIG. 1 is a cross sectional view of a hollow cylindrical magnet with an idealized eight pole radial magnetization.
Figure 2:
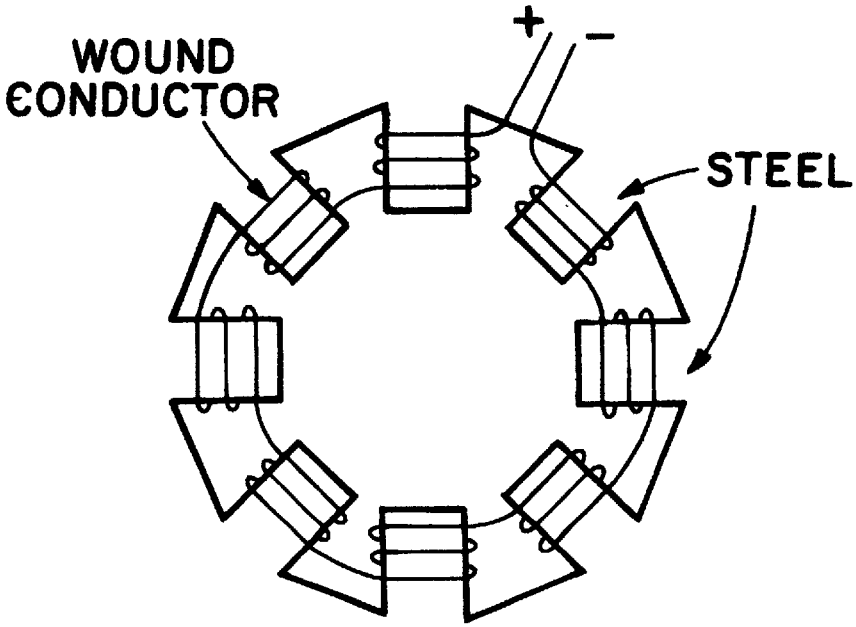
FIG. 2 is a cross sectional view of a steel cored multi-pole magnetization fixture.
Figure 3A:
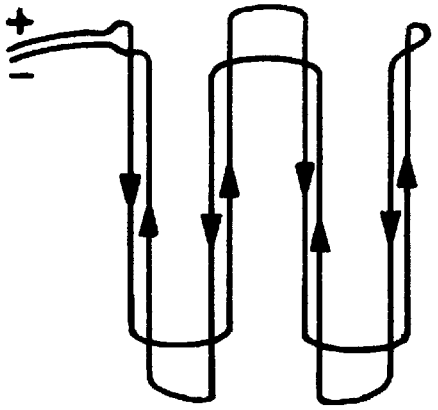
FIG. 3*a* is a perspective view of an air cored, wound conductor magnetization fixture.
Figure 3B:
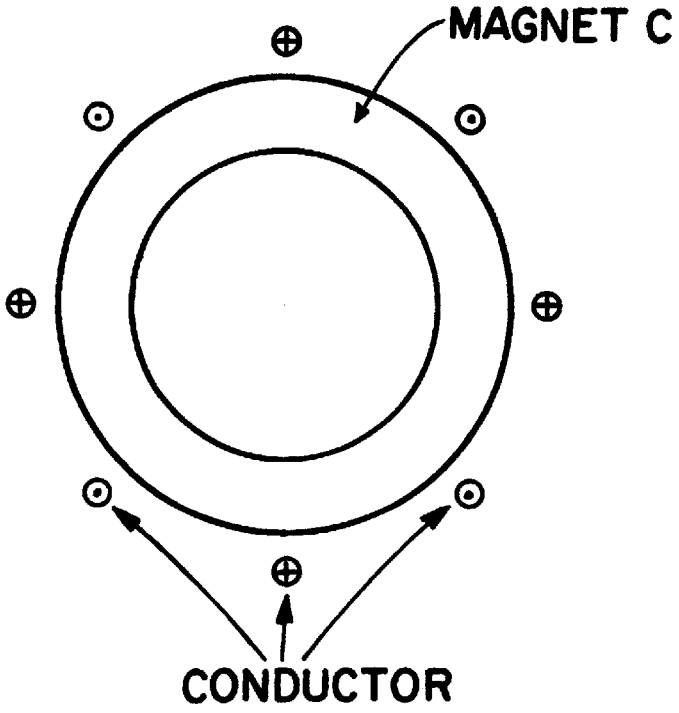
FIG. 3*b* is a cross sectional view of a hollow cylindrical magnet surrounded by the air cored, wound conductor magnetization fixture of FIG. 3*a*.
Figure 4:
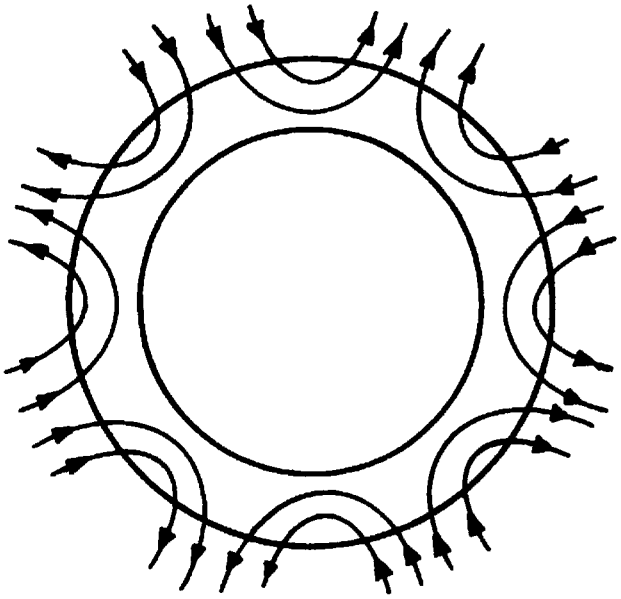
FIG. 4 is a cross sectional view of a hollow cylindrical magnet with an actual eight pole magnetization.
Figure 5:
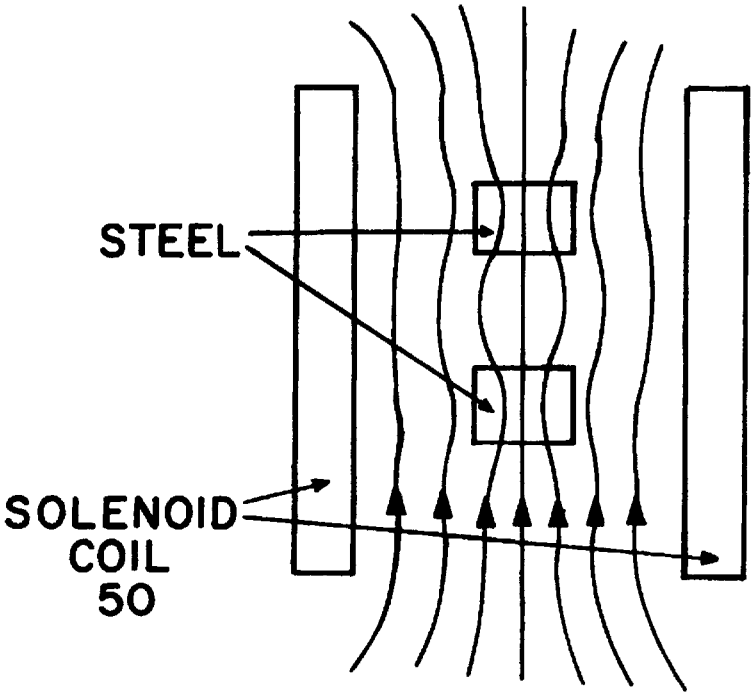
FIG. 5 is a schematic cross sectional view of the magnetic field in the bore of a solenoid fixture focused by the presence of high permeability soft steel components therein.
Figure 8:
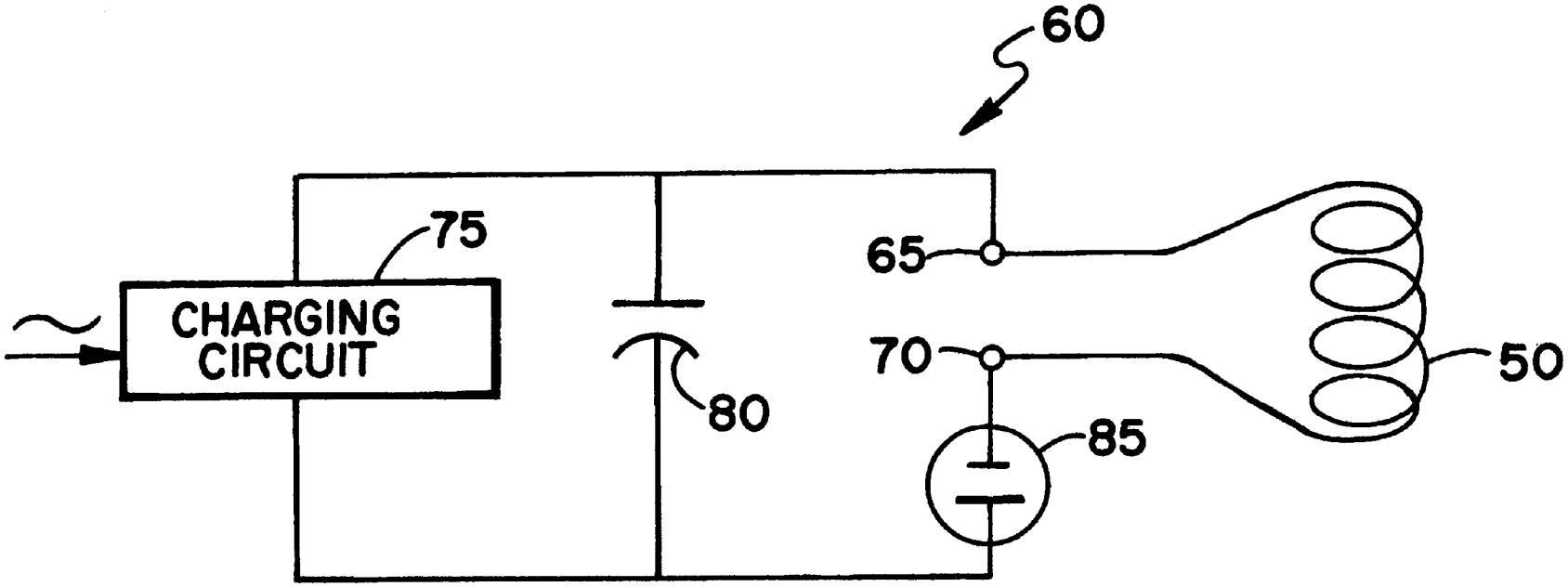
FIG. 8 is a schematic view of a suitable means for directing a high magnetic field through the high permeability soft magnetic component and hollow cylindrical member.

A suitable power source 60 and helical solenoid coil member 50 are schematically shown in FIG. 8. The power source 60 is a capacitor discharge magnetizing apparatus with terminals 65, 70 connected to the solenoid coil member 50. The capacitor discharge magnetizing apparatus includes a charging circuit 75, a capacitor storage means 80, and a switching device 85, such as an ignitron or similar device, coupled as illustrated schematically in FIG. 8. When the magnetizing power source 60 is activated, a current pulse passes through the solenoid coil member 50 causing a magnetic flux to pass through the fixture device 10 and contained hollow cylindrical member C. This produces a shaped magnetic field as depicted in FIG. 5, resulting in a strong axial magnetic field in the axial bore B of the hollow cylindrical member.

Figure 9B:
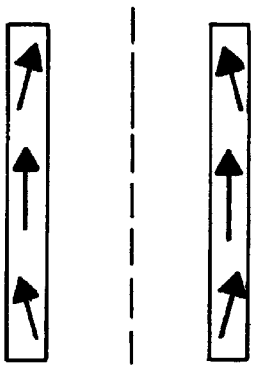
FIGS. 9*a* and 9*b* are cross sectional views of a hollow cylindrical magnet with idealized magnetization and "focused" magnetization, respectively.
Figure 9A:
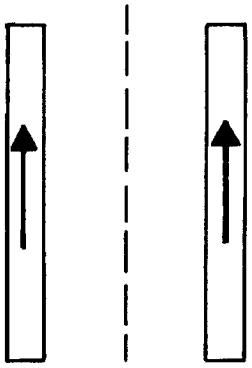
Figure 9C:
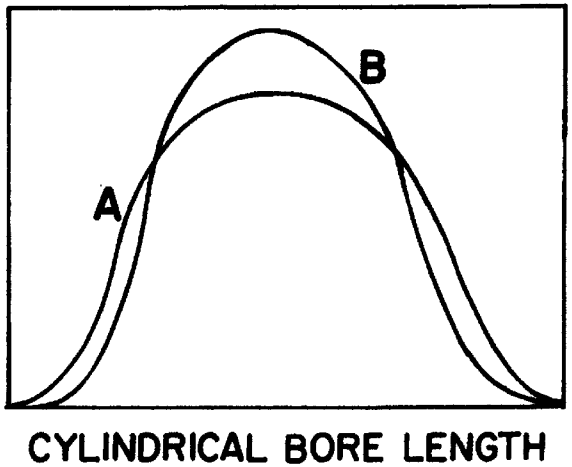
FIG. 9*c* is a graphical representation of the field strengths along the axial bores of the hollow cylindrical magnets of FIGS. 9*a* and 9*b*.

FIGS. 9*a* and 9*b* are cross sectional views of a hollow cylindrical magnet member C with idealized magnetization represented by a single vector in FIG. 9*a*, and focused magnetization represented by multiple vectors in FIG. 9*b*. FIG. 9*c* is a graphical representation of the magnetic field strengths along the axial bores B of the hollow cylindrical magnets of FIGS. 9*a* and 9*b*.

The invention also includes a method of magnetizing a hollow cylindrical member to produce a high axial magnetic field in the cylindrical member's axial bore using the fixture assembly described above.

The method comprising the first step of positioning at least one high permeability soft magnetic component along the cylindrical member's longitudinal axis. A means is provided for maintaining the high permeability soft magnetic component positioned along the cylindrical member's longitudinal axis. A means is provided for directing a high magnetic field through the at least one high permeability soft magnetic component positioned along the cylindrical member's longitudinal axis. Finally, a high magnetic field is directed through the at least one high permeability soft magnetic component positioned along the cylindrical member's longitudinal axis, thereby producing a permanent magnet hollow cylindrical member having a strong axial magnetic field in the axial bore thereof.

EXAMPLES

The electrical and magnetic properties of the equipment and materials described in the following examples are expressed using the International System of Units (SI). The tesla (T) is the SI unit of magnetic flux density. The millitesla (mT) is $1\times10^{-3}$ tesla. The volt (V) is the SI unit of electrical potential difference. The farad (F) is the SI unit of capacitance of a capacitor. The micro farad (uF) is $1\times10^{-6}$ farad. The examples presented are intended for illustration purposes only, and are not limiting to the overall invention in any sense.

Example 1

A hollow cylinder of isotropic NdFeB was manufactured using Magnequench MQP-B powder (approximately 40% by volume) with an epoxy binder (approximately 60% by volume) by a standard compression molding technique. The resulting sample was 12 mm long with an outside diameter of 9.5 mm and a wall thickness of about 1 mm. The part was magnetized in a solenoid coil of 25 mm internal diameter, with a single pulse from a capacitor discharge bank (6,000 uF at 2,500 volts). The peak field produced in the bore of the solenoid was approximately 4 Tesla. After magnetizing the sample part, the peak field produced in the bore of the magnetized sample part was found to be 32 mT. To verify that the sample part had, in fact, been saturated, the part was re-magnetized at a higher applied field of 4.5 Tesla. The peak field produced in the bore of the re-magnetized sample part was again found to be 32 mT. All measurements were made using a calibrated axial Hall probe and gaussmeter.

Another sample part of identical shape and composition was magnetized employing the same solenoid coil, with the same applied pulse from the capacitor bank. However, this time two steel balls 11.5 mm in diameter were placed at either end of the sample part and the balls held in position with soft pads during the magnetization process. After magnetization, the field in the bore of the magnetized sample part was measured using the same axial Hall probe and gaussmeter. The peak field produced in the bore of this magnetized sample part was found to be 43 mT.

Example 2

A hollow cylinder of isotropic ferrite was manufactured from strontium ferrite powder (approximately 60% by volume) with a nylon 6 binder (approximately 40% by volume) by a standard compression molding technique. The resulting sample was 10 mm long with an outside diameter of 7 mm and a wall thickness of 1.2 mm. The part was magnetized in a solenoid coil of 25 mm internal diameter, with a single pulse from a capacitor discharge bank (6,000 uF at 2,500 volts). The peak field produced in the bore of the solenoid was approximately 4 Tesla. After magnetizing the sample part, the peak field produced in the bore of the magnetized sample part was found to be 4.5 mT. All measurements were made using a calibrated axial Hall probe and gaussmeter.

Another sample part of identical shape and composition was magnetized employing the same solenoid coil. However, this time two steel balls 9 mm in diameter were placed at either end of the sample part and the balls held in position with soft pads during the magnetization process. In addition, the applied pulse from the capacitor bank was much lower in energy (2,000 uF at 1,200 volts). The lower energy condition was employed because a field of 1 Tesla or less is sufficient to effectively saturate ferrite materials, since ferrites have a much lower coercivity compared to NdFeB materials.

After magnetization, the field in the bore of the magnetized sample part was measured using the same axial Hall probe and gaussmeter. The peak field produced in the bore of this magnetized sample part was found to be 12.5 mT. The same sample was re-magnetized in the solenoid at full power (6,000 uF at 2,500 volts), but without the two steel balls present. The peak field produced in the bore of the re-magnetized sample part was now found to be 4.6 mT.

MATHEMATICAL MODELING

In order to investigate the contention that the enhanced performance of the magnets produced in Examples 1 and 2 can be attributed to a focusing of the magnetization, mathematical modeling was performed on a 2D axisymetrical model, using finite element analysis (FEA). The FEA package used was Infolytica MagNet5, using material properties that had been measured on a permeameter system.

Two materials were chosen for modeling, an isotropic bonded NdFeB of similar loading to the material described in Example 1, and an isotropic bonded ferrite of similar loading to the material used in Example 2. Two series of calculations were performed for each material. The first series included the assumption that the direction of magnetization is parallel to the axis of the hollow cylinder test part. The second series included the assumption that the areas of the hollow cylinder test piece close to the ends are magnetized at approximately 30 degrees from the axial direction. The amount of material that was designated as "focused" or magnetized off axis was 40% of the total magnet volume. Therefore, a magnet of 10 units in length would contain the top two and the bottom two length units with "focused" or off axis magnetization. This assumption is based on the amount of field distortion that is believed to take place with the geometry of the test piece. A representation of the assumed magnetization for each series of calculations is shown in FIGS. 9*a* and 9*b*. The resulting field along the bore of the test piece for each series of calcuations is shown in FIG. 9*c*.

RESULTS OF MATHEMATICAL ANALYSIS

Bonded NdFeB:

The material similar to that of Example 1 with magnetization parallel to the axis of the hollow cylinder was calculated to have a peak field level along the center line of 28.7 mT. The same material with 40% off axis magnetization was calculated to have a peak field level along the center line of 35.5 mT, an increase of approximately 24%.

Bonded Ferrite:

The material similar to that of Example 2 with magnetization parallel to the axis of the hollow cylinder was calculated to have a peak field level along the center line of 7.2 mT. The same material with 40% off axis magnetization was calculated to have a peak field level along the center line of 9.1 mT, an increase of approximately 26%.

The calculated values for the field in the bore is in quite close agreement with the experimental results from Example 1. These results confirm that the proposed model is consistent with the observed results. The calculated values for the field bore in Example 2 is in general agreement with the experimental results. It is believed that the reason the ferrite calculations do not match the measured values found in Example 2, is that the lower applied field in Example 2 results in a greater focusing of the magnetizing field, resulting in a greater increase in the field in the bore of the sample part.

While the invention has been particularly shown and described with reference to a preferred embodiment thereof, it will be understood by those skilled in the art that various changes in form and details may be made therein without departing from the spirit and scope of the invention.

I claim:

1. A fixture assembly for magnetizing a permanent magnet hollow cylindrical member with an axial bore and longitudinal axis there through, to produce a high axial magnetic field in the cylindrical member's axial bore, said fixture assembly comprising:

(a) at least one high permeability soft iron magnetic component positioned along the cylindrical member's longitudinal axis;

(b) means for maintaining said at least one high permeability soft iron magnetic component in position along the cylindrical member's longitudinal axis; and (c) means for directing a high magnetic field through the high permeability soft iron magnetic component and hollow cylindrical member.

2. The assembly according to claim 1 wherein said at least one high permeability soft iron magnetic component is positioned at least partially within the cylindrical member's axial bore.

3. The assembly according to claim 1 wherein said at least one high permeability soft iron magnetic component is positioned completely within the cylindrical member's axial bore.

4. The assembly according to claim 1 wherein said maintaining means comprises a holder member supporting said at least one highly permeability soft iron magnetic component positioned along the cylindrical member's longitudinal axis.

5. The assembly according to claim 4 wherein said holder member supporting said at least one highly permeability soft iron magnetic component positioned along the cylindrical member's longitudinal axis is made of essentially non-magnetic material.

6. The assembly according to claim 1 wherein said highly permeability soft iron magnetic component comprises a spherical soft iron member.

7. The assembly according to claim 6 wherein said highly permeability soft iron magnetic component comprises a pair of spherical soft iron members positioned at opposite ends of the cylindrical member's axial bore.

8. The assembly according to claim 7 wherein said spherical soft iron members positioned at opposite ends of the cylindrical member's axial bore have a diameter greater than the cylindrical member's axial bore.

9. The assembly according to claim 1 wherein said means for directing a high magnetic field through the high permeability soft iron magnetic component and hollow cylindrical member comprises a solenoid coil surrounding said means for maintaining said at least one high permeability soft iron magnetic component positioned along the cylindrical member's longitudinal axis, the high permeability soft iron magnetic component and hollow cylindrical member contained therein, the solenoid coil carrying a high current pulse from a power source connected thereto.

10. A fixture assembly for magnetizing a permanent magnet hollow cylindrical member with an axial bore and longitudinal axis there through, to produce a high axial magnetic field in the cylindrical member's axial bore, comprising:

(a) a pair of spherical soft iron members positioned along the cylindrical member's longitudinal axis and at opposite ends of the cylindrical member's axial bore, each spherical soft iron member positioned at least partially within the cylindrical member's axial bore;

(b) a holder member supporting said pair of spherical soft iron members in position at opposite ends of the cylindrical member's axial bore, each spherical member positioned at least partially within the cylindrical member's axial bore; and (c) means for directing a high magnetic field through the pair of spherical soft iron members positioned along the cylindrical member's longitudinal axis.

11. The assembly according to claim 10 wherein said means for directing a high magnetic field through the pair of spherical soft iron members and hollow cylindrical member comprises a solenoid coil surrounding the high permeability soft iron magnetic members and hollow cylindrical member, the solenoid coil carrying a high current pulse from a power source connected thereto.

12. A method of magnetizing a permanent magnet hollow cylindrical member with an axial bore and longitudinal axis there through, comprising the steps:

(a) positioning at least one high permeability soft iron magnetic component along the cylindrical member's longitudinal axis;

(b) providing means for maintaining said at least one high permeability soft iron magnetic component positioned along the cylindrical member's longitudinal axis;

(c) providing means for directing a high magnetic field through the at least one high permeability soft iron magnetic component positioned along the cylindrical member's longitudinal axis; and (d) directing a high magnetic field through the at least one high permeability soft iron magnetic component positioned along the cylindrical member's longitudinal axis, thereby producing a permanent magnet hollow cylindrical member having a strong axial magnetic field in the axial bore thereof.

13. The method of magnetizing a permanent magnet hollow cylindrical member of claim 12 wherein said means for directing a high magnetic field is a solenoid coil surrounding said means for maintaining said at least one high permeability soft iron magnetic component positioned along the cylindrical member's longitudinal axis, the high permeability soft iron magnetic component and hollow cylindrical member contained therein, the solenoid coil carrying a high current pulse from a power source connected thereto.

* * * * *